US005352953A

United States Patent [19]

Wakabayashi et al.

[11] Patent Number: 5,352,953

[45] Date of Patent: Oct. 4, 1994

[54] GAS-FILLED DISCHARGE TUBE

[75] Inventors: Seiichi Wakabayashi; Takashi Hirano; Yukio Sone; Toshikazu Ashizawa, all of Shizuoka, Japan

[73] Assignee: Yazaki Corporation, Tokyo, Japan

[21] Appl. No.: 861,732

[22] Filed: Apr. 1, 1992

[30] Foreign Application Priority Data

Apr. 5, 1991 [JP] Japan ..... 3-072000

[51] Int. Cl.[5] ..... H01J 17/06; H01J 17/10

[52] U.S. Cl. ..... 313/631; 313/632; 313/624; 313/634; 313/623

[58] Field of Search ..... 313/631, 632, 634, 623, 313/624, 625

[56] References Cited

U.S. PATENT DOCUMENTS

| | | | |
|---|---|---|---|
| H60 | 5/1986 | Elkins et al. | 313/631 |
| 3,995,183 | 11/1976 | Lechner et al. | 313/631 |
| 5,111,109 | 5/1992 | Yagi et al. | 313/624 |
| 5,166,574 | 11/1992 | Yagi et al. | 313/631 |
| 5,185,556 | 2/1993 | Yagi et al. | 313/631 |

FOREIGN PATENT DOCUMENTS

| | | |
|---|---|---|
| 0229303A1 | 12/1985 | European Pat. Off. . |
| 0407975A2 | 1/1991 | European Pat. Off. . |
| 0408954A2 | 1/1991 | European Pat. Off. . |

*Primary Examiner*—Donald J. Yusko
*Assistant Examiner*—N. D. Patel
*Attorney, Agent, or Firm*—Nikaido, Marmelstein, Murray & Oram

[57] ABSTRACT

A gas-filled discharge tube includes a tubular body formed of an electrically insulating material, and has engaging portions respectively at opposite ends thereof. A pair of electrode bases are provided; at least one of the electrode bases is formed of an electrically conducting thin metal sheet, airtightly adhered to the respective open ends. A pair of discharge electrodes are provided; the discharge electrodes have flange portions which are engaged with the respective engaging portions and sandwiched between the tubular body and the respective electrode bases. One of the electrode bases is formed with a gas filling bore by a laser beam for filling an inert gas. The gas filling bore is welded by the laser beam after the inert gas is filled in the tubular body, so as to seal and enclose the inert gas therein.

4 Claims, 7 Drawing Sheets

GAS-FILLED DISCHARGE TUBE

BACKGROUND OF THE INVENTION

1. Field of the Invention

The present invention relates to a gas-filled discharge tube, and more particularly to a gas-filled discharge tube for operation as a series gap of an ignition system of an automotive spark-ignition engine or the like.

2. Description of the Prior Art

There has been proposed a conventional gas-filled discharge tube for operation as a series gap of an ignition system of an automotive spark-ignition engine or the like. One such conventional tube is disclosed by the same applicant as the present specification; Japanese Utility Model Laid-open No. 1-82245.

FIG. 6 shows a conventional gas-filled electric discharge tube 1 as noted above, wherein at the opposite open ends of a tubular body 2 formed of an electrically insulating material such as ceramic. There are formed a pair of electrode bases 4*a* and 4*b* airtightly adhered to the respective open ends for installing electrodes 3*a* and 3*b* as discharge electrodes. These electrodes are formed by pressing a porous metal sheet on the respective electrode bases 4*a* and 4*b*, and to this structure, a gas-filled tube 5 is airtightly mounted on one electrode base 4*a*. A connecting portion 6 (which is explained later on) is protrudingly formed on the other electrode base 4*b*. With this construction, a gas-filled discharge tube 1 is formed such that a high-pressurized inert gas is injected into the tubular body 2 from the gas-filled tube 5. After the completion of the gas injection, the tube 5 is sealed by a gas sealing member 7, and thereafter a cylindrical shaped protection terminal 8 is provided to cover the external side of the tube 5. An electrically conducting adhesive member 9 is filled between the protection terminal 8 and the tube 5.

The gas-filled discharge tube 1 as constructed above as shown in FIG. 7, is incorporated into a plug gap 10 which is to be engaged with a terminal of the spark plug. A pair of intermediate connecting terminals 14, 14, are formed respectively at one end of the connecting terminal 11 and at one end of a cable terminal 13 connected to an end portion of a high-voltage cable 12, and are engageably fixed respectively with the protection terminal 8 of the electrode base 4*a* and the connecting portion 6 of the electrode base 4*b* of the gas-filled discharge tube 1. A so-called series gap is thereby connected in series to the spark plug.

However, in the conventional gas-filled discharge tube 1 of the above construction, since the gas-filled tube for injecting the gas into the tubular body 2 and the protection terminal 8 are largely protruding from the electrode base 4*a*, the whole length of the discharge tube 1 becomes substantially long. As a result the plug cap 10 for incorporating the discharge tube 1 therein is forced to undesirably increase in size, so that a minimization of the size of the above ignition system with a series gap becomes difficult. Consequently if an automobile has not a large capacity for mounting engine auxiliary devices or the like, it will become difficult to adopt such an ignition system therein.

SUMMARY OF THE INVENTION

The present invention has been made to eliminate such problems as described above, and it is an object of the present invention to provide a discharge tube which is capable of making the discharge tube itself smaller to minimize a plug cap that incorporates the discharge tube therein. This allows a minimization of the size of the whole ignition system having a series gap.

In order to achieve the above object, the gas-filled discharge tube according to the present invention is constructed such that it comprises a tubular body formed of an electrically insulating material and having a notch portion at least one of the opposite open ends thereof. A notch or projecting portion is provided at the other open end thereof. A pair of electrode bases are provided, at least one of which is formed of an electrically conducting thin metal sheet, airtightly adhered to the respective open ends. A pair of discharge electrodes having flange portions to be engageably fixed with the notch and/or projecting portions are provided and sandwiched between the tubular body and the respective electrode bases. In this construction, the electrode base is first formed with a gas filling bore by a laser beam for filling an inert gas, with the bore being welded also by the laser beam after the inert gas is filled in the tubular body so as to enclose the gas therein.

By the present invention, it is no longer necessary to use a gas-enclosed tube to inject a gas to the tubular body because of the above gas filling bore. Therefore the above conventionally adopted gas-enclosed tube that largely protrudes from the electrode base can be obviated, thereby a reduction of the whole length of the gas-filled discharge tube can be made possible. These advantages are achieved because the present invention is constructed such that at least one of the electrode bases supporting discharge electrodes are airtightly adhered to the electrically insulating tubular body, and are formed of an electrically conducting thin sheet. Additionally, the electrode base is formed with a bore which is made by a laser beam for filling the inert gas, and also welded by the laser beam after the inert gas filling operation is completed.

Other objects and features of the invention will be more fully understood from the following detailed description and appended claims when taken in conjunction with the accompanying drawings.

Figure 1:
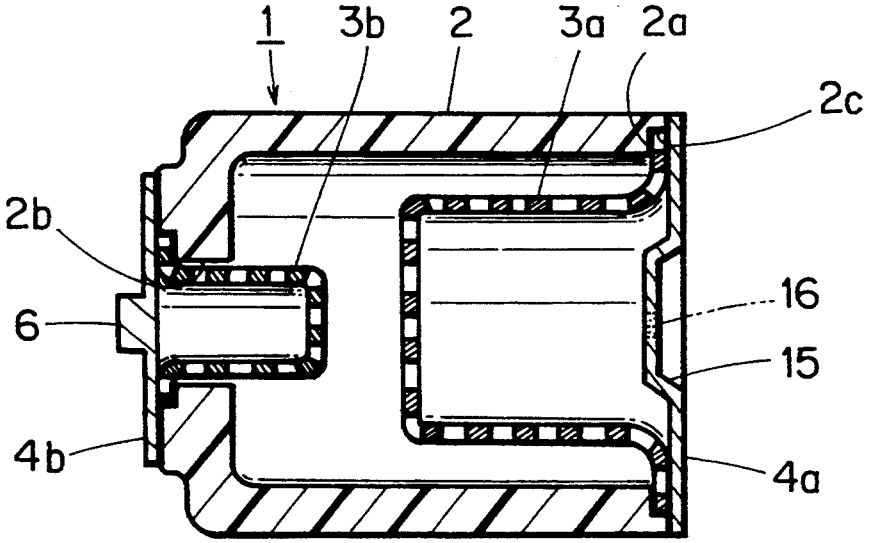
FIG. 1 is a sectional view of the gas-filled discharge tube according to one embodiment of the present invention.

In the drawings, reference numeral 1 denotes a gas-filled discharge tube, numeral 2 denotes a tubular body, 3*a* and 3*b* respectively denote electrodes, 4*a* and 4*b* respectively denote electrode bases, 5 a gas-enclosed tube 6 a connecting portion, 8 a protection terminal, 10 a plug cap, 14 an intermediate connecting terminal, 16 a gas filling bore, 17 an electrically conducting spring, 18 a carrier belt, 19 a welding device, 20 a laser beam and reference numeral 21 denotes an installing projection.

DETAILED DESCRIPTION OF THE PREFERRED EMBODIMENTS

In the following, one embodiment of the present invention is described with reference to the FIGS. 1 to 5.

FIG. 1 is an illustration showing one embodiment of a gas-filled discharge tube 1 according to the present invention. The discharge tube comprises a tubular body 2 formed of an electrically insulating material such as ceramic, one end of which is formed with an aperture 2*a* of a large diameter, while the other end thereof is formed with the other aperture 2*b* of a small diameter. Notch portions 2*c*, 2*c* are provided at the respective apertures 2*a* and 2*b*, With this construction, discharge electrodes 3*a* and 3*b*, which are respectively formed by pressing a porous metal sheet so as to fit with each of these apertures, are engageably fixed with these notch portions 2*c*, 2*c* of the respective apertures 2*a* and 2*b* of the tubular body 2. Electrodes 3*a* and 3*b* are supported by electrode bases 4*a* and 4*b* respectively, which are airtightly adhered to the end surfaces of the respective apertures of the tubular body 2 through soldering or the like.

Here, the electrode base 4*a* of a large diameter for supporting the electrode 3*a* of a large diameter is formed of a thin metal sheet whose thickness is below 1.00 mm, and this electrode base 4*a* is further formed with a dented portion 15 at the center portion thereof to be contacted with an electrically conducting spring 17 (explained later). Dented portion 15 is further formed with a tiny gas filling bore 16 which, as explained later on, is welded closed after the gas filling operation is completed so as to enclose the gas in the tubular body. On the other hand, the other electrode base 4*b* of a small diameter for supporting the electrode 3*b* of a small diameter is formed of a lid-like metal sheet, at the center portion of which a connecting portion 6 is protrudingly formed just like the above-explained conventional device.

Figure 2:
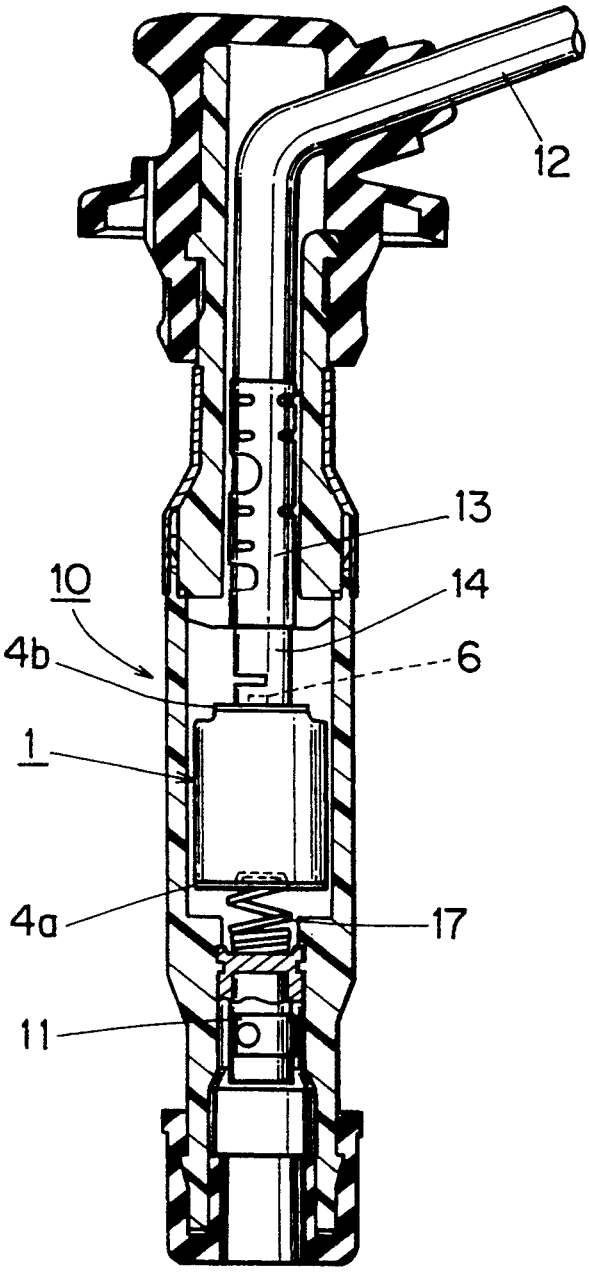
FIG. 2 is a sectional view showing the state that the gas-filled discharge tube of FIG. 1 is incorporated into a plug cap.

Thereafter, a gas-filled discharge tube 1 enclosing an inert gas is, as shown in FIG. 2, incorporated into a plug cap 10 which is to be engageably fixed to a terminal of the spark plug. Spring 17 is suppressedly provided between a connecting terminal 11 to be connected to the spark plug and the electrode base 4*a* of the discharge tube 1, and a connecting portion 6 of the other electrode base 4*b* is engageably fixed to an intermediate connecting terminal 14 provided to a cable terminal 13 which is connected to one end of the high-voltage cable 12. A so-called series gap is thereby connected in series to the spark plug.

In the following, an assembling process for the above gas-filled discharge tube 1 is explained.

Figure 3:
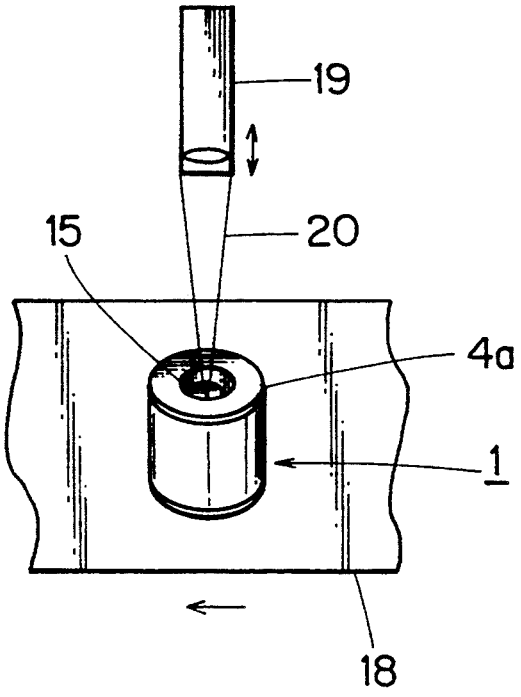
FIG. 3 is an illustration showing one embodiment of a welding device to be used for assembling the gas-filled discharge tube of FIG. 1.

First, the electrodes 3*a* and 3*b* are engageably fixed to the notch portions 2*c*, 2*c* of the respective apertures 2*a* and 2*b* of the above tubular body 2, and the electrode bases 4*a* and 4*b* are airtightly adhered through soldering or the like to the respective end surfaces of the tubular body 2. The discharge tube 1 without inert gas enclosed therein is first assembled. Then, as shown in FIG. 3, the discharge tube 1 with the electrode base 4*a* side facing upward using a jig or the like is placed on a carrier belt 18. Here, the carrier belt 18 is extended to the inner side of a chamber (not shown) having a pressure-proof character, a welding device 19 such as a YAG laser is movably mounted in respective vertical directions, above the carrier belt 18 with the chamber.

In the above state, the carrier belt 18 is moved in a step-by-step form, and when the discharge tube 1 comes just below the welding device 19, the welding device 19 is activated to irradiate a laser beam 20 onto the center portion of the electrode base 4*a* of the discharge tube 1 for 1 to 10 shots. This forms a gas filling bore 16 having a diameter 0.3 to 1.00 mm on the electrode base 4*a*. Thereafter, the chamber in which the discharge tube 1 is located is put in a vacuum state, and high-pressurized Argon or Xenon gas and a mixed gas with a rare gas N2 are injected into the chamber so as to fill the chamber with the inert gas. By this operation, the high-pressurized inert gas is filled into the discharge tube 1 by way of the above gas filling bore 16.

Figure 4A:
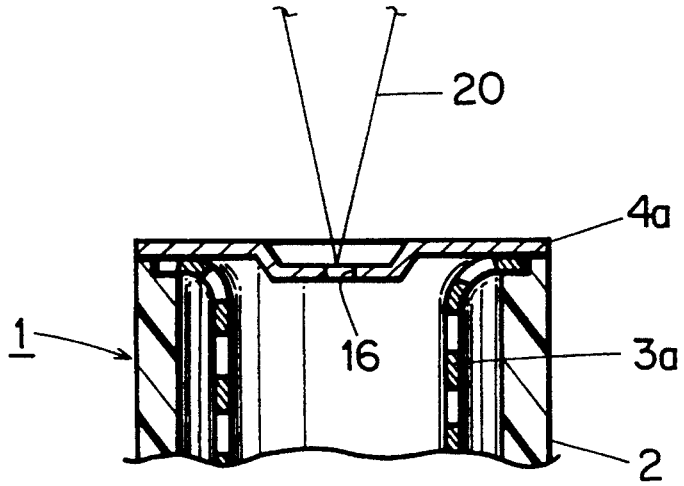
FIGS. 4A and 4B are illustrations respectively showing the state that an bore is formed and that the bore is welded to be sealed both by a laser beam.
Figure 4B:
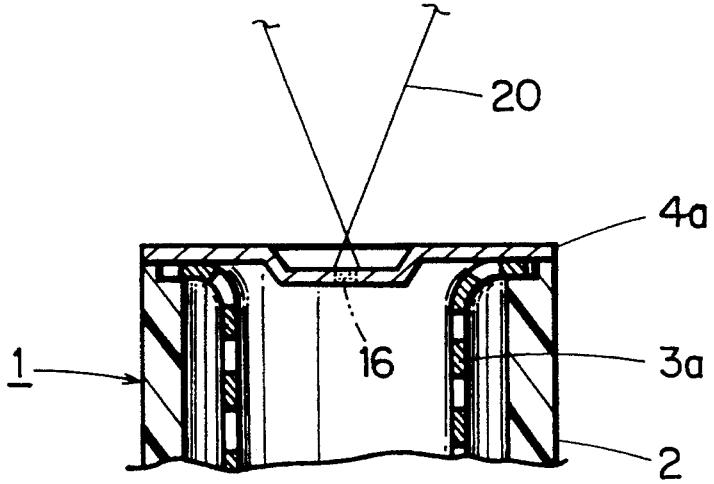

After the above operation, the welding device 19 held at the location where the gas filling bore 16 is formed is slightly moved upward and downward so as to shift the focal point of the laser beam 20 and irradiate the laser beam 20 again onto the center portion of the electrode base 4*a* of the discharge tube 1. By this operation, as shown in FIG. 4B, the gas filling bore 16 formed on the above discharge tube 1 is welded and sealed, and a gas-filled discharge tube having a high-pressurized inert gas enclosed therein is thereby formed.

In the present embodiment an electrode base 4*a* of a large diameter is airtightly adhered to the tubular body 2 for supporting the electrode 3*a* of a large diameter is formed of a thin metal sheet, and is also formed with a gas filling bore 16 by a laser beam 20 which bore is welded to be closed also by the laser beam 20 after the inert gas filling operation is completed. As a result the gas can be filled into the tubular body 2 by way of the gas filling bore 16 obviating the use of a conventionally adopted gas-enclosed tube. Additionally the gas-enclosed tube largely protruding from the electrode base 4 is also rendered unnecessary, thereby enabling the whole length of the gas-filled discharge tube 1 to be shortened. Further, by minimizing the size of the gas-filled discharge tube 1 as above, the plug cap 10 of an ignition system having a so-called series gap for incorporating this discharge tube 1 therein can also be minimized, so that the whole ignition system having a series gap can be minimized. As a result, an engine room adopting such ignition system can have more space for other functions.

The assembling procedure for the present invention is such that a discharge tube 1 without any inert gas enclosed therein is first formed, and carried into a chamber where the laser beam 20 is irradiated onto an electrode base 4*a* thereof formed of a thin metal sheet to form a gas filling bore 16. Additionally after the completion of the gas filling operation by way of this gas filling bore 16, the laser beam 20 is again irradiated to the focal point slightly shifted from the above made bore so as to weld and seal this gas filling bore 16. As a result, a mechanical assembling procedure of the discharge tube 1 which should conventionally be done in a chamber full of high-pressurized gas can be avoided, and the device for manufacturing the gas-filled discharge tube 1 can be prevented from becoming large and complicated, so that its manufacturing cost can be greatly reduced.

Still further, since the gas filling bore 16 which has been formed by a laser beam 20 can be easily welded only by shifting the focal point of the laser beam 20, a laser beam treating operation itself can be largely facilitated, thereby the productivity thereof can be enormously improved.

Both of the electrode bases 4*a* and 4*b* airtightly adhered to the opposite end portions of the tubular body 2 can be respectively formed of thin metal sheets, and the electrodes 3*a* and 3*b* to be engageably fixed to the tubular body 2 can be formed of a same diameter.

Figure 5:
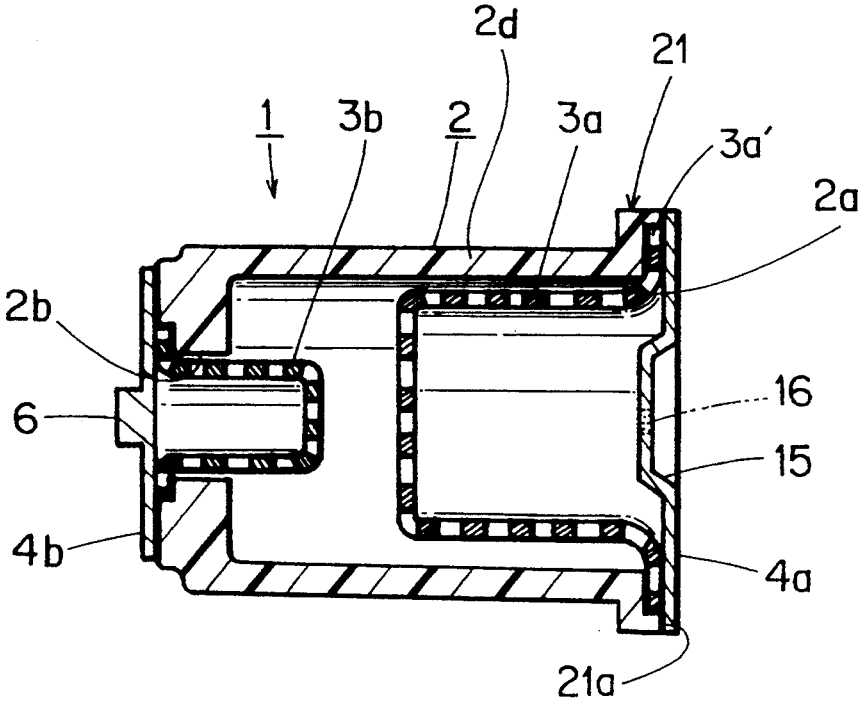
FIG. 5 is a sectional view of the gas-filled discharge tube according to another embodiment of the present invention.
Figure 6:
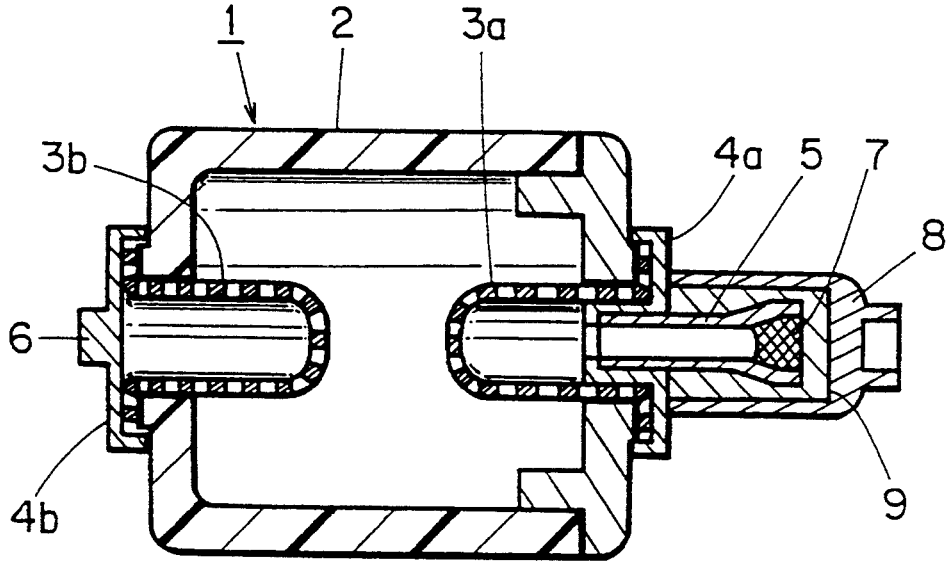
FIG. 6 PRIOR ART
FIG. 6 is a sectional view of a conventional gas-filled discharge tube; and, FIG. 7 is a sectional view showing the state that the conventional gas-filled discharge tube is incorporated into a plug cap.
Figure 7:
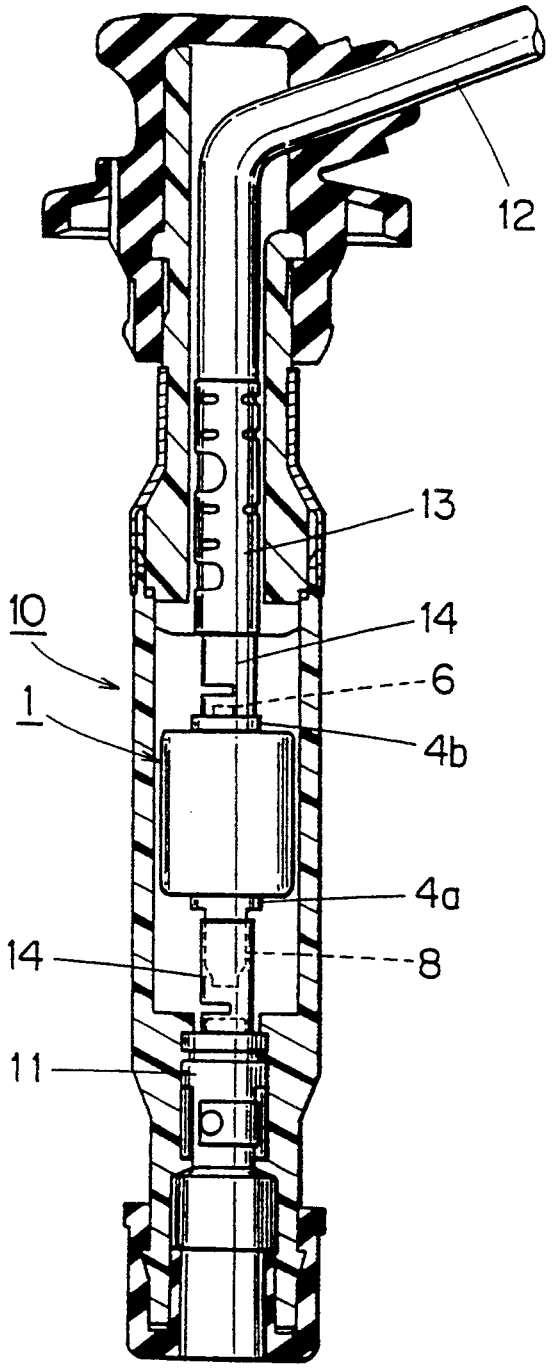
FIG. 7 PRIOR ART

FIG. 5 is an illustration showing a gas-filled discharge tube according to another embodiment of the present invention. In this embodiment, the inner peripheral wall 2*d* of the tubular body 2 is formed as thin as possible to the extent that it can endure the high-pressure of the inert gas filled into the tubular body 2. An installing projection 21 is formed at the aperture 2*a* of a large diameter of the tubular body 2, whereby a flange portion 3*a*' of a the large diameter electrode 3*a* is engageably fixed to the aperture 2*a*. In the state that the electrode 3*a* is engageably fixed to the installing projection 21 of the tubular body 2, an electrode base 4*a* of a large diameter is further airtightly adhered to the end surface 21*a* of the installing projection 21.

This above construction is same as that of the first embodiment in that the electrode base 4*a* is formed of a thin metal sheet, and that the gas filling bore 16 formed in the electrode base 4*a* is welded to seal the bore after the inert gas is filled therein.

In this embodiment also, the gas can be filled into the tubular body 2 by way of the gas filling bore 16 without using a conventionally adopted gas-enclosed tube, so that the gas-enclosed tube largely protruding from the electrode base 4 is not needed, thereby allowing the whole length of the gas-filled discharge tube 1 to be shortened. Further, by minimizing the size of the gas-filled discharge tube 1 as above, the whole ignition system having a series gap can be minimized.

Furthermore, with the above construction, by forming the inner peripheral wall 2*d* of the tubular body 2 as thin as possible, the weight of the whole gas-filled electric discharge tube 1 can be reduced. By minimizing the quantity of an electrically insulating material such as ceramic forming the tubular body 2, the manufacturing cost for the whole discharge tube 1 can also be reduced. Therefore the total weight of the whole ignition system having a series gap to incorporate this discharge tube 1 therein, and the total cost for its production can also be greatly reduced.

EFFECT OF THE INVENTION

As mentioned heretofore, a gas-filled discharge tube according to the present invention is constructed such that it comprises a tubular body formed of an electrically insulating material, and electrode bases to be airtightly adhered thereto. At least one of which electrode bases is formed of an electrically conducting thin sheet, wherein the electrode base is formed with a gas filling bore 16 by a laser beam so as to first fill the gas, and then welded to close the bore by the laser beam after the inert gas filling operation is completed. The inert gas can be filled into the tubular body 2 by way of the gas filling bore without using a conventionally adopted gas-enclosed tube, so that the conventional gas-enclosed tube largely protruding from the electrode base 4 can be rendered unnecessary, and thereby the whole length of the gas-filled electric discharge tube 1 can be shortened, and consequently, the size of the whole ignition system having a series gap for incorporating the discharge tube therein can be minimized.

Although the invention has been described with a certain degree of particularity, obviously many changes and variations are possible therein. It is therefore to be understood that the invention may be practiced otherwise than specifically described herein without departing from the scope and spirit thereof.

What is claimed is:

1. A gas-filled discharge tube comprising:

a tubular body formed of an electrically insulating material and having engaging notch portions respectively at opposite open ends thereof;

a pair of electrode bases, at least one of which is formed of an electrically conducting thin metal sheet, airtightly adhered to said open ends of said tubular body, with at least one of said electrode bases being formed with a dented section at the center portion thereof to form a gas-filling bore therein; and a pair of discharge electrodes respectively having flange portions to be engaged with said respective engaging notch portions and sandwiched between said tubular body and said respective electrode bases, wherein said tubular body is filled with an inert gas through said gas filling bore, said gas filling bore being formed and closed by a laser beam.

2. A gas-filled discharge tube as claimed in claim 1, wherein one of said engaging notch portions is a projecting portion formed around the periphery of said tubular body, whereby the flange portion of one of said electrodes is engageably fixed in said projecting portion sandwiched between said tubular body and one of said electrode bases facing to said projecting portion of said tubular body.

3. A gas-filled discharge tube as claimed in claim 1, wherein a focal point of said laser beam can be readily changed in vertical directions.

4. A gas-filled discharge tube as claimed in claim 3, wherein the inner peripheral wall of said tubular body is formed thin to the extent that it can endure the high-pressure of said inert gas filled into said tubular body.

* * * * *